US005644094A

United States Patent [19]

Dickson, II

[11] Patent Number: 5,644,094

[45] Date of Patent: Jul. 1, 1997

[54] BRIDGE FOR STRINGED MUSICAL INSTRUMENTS

[76] Inventor: George E. Dickson, II, 1224 Escalon Ave., Escalon, Calif. 95320

[21] Appl. No.: 391,927

[22] Filed: Feb. 21, 1995

[51] Int. Cl.[6] ..... G10D 3/04

[52] U.S. Cl. ..... 84/307; 84/298

[58] Field of Search ..... 84/298, 307

[56] References Cited

U.S. PATENT DOCUMENTS 4,899,634 2/1990 Geiger ..... 84/307

*Primary Examiner*—Patrick J. Stanzione

*Attorney, Agent, or Firm*—Claude A.S. Hamrick

[57] ABSTRACT

Improved bridge for stringed musical instruments having a single unitary member configured in a somewhat comblike structure, the backbone portion of which forms a string-engaging and supporting surface. The teeth-forming portions form a plurality of sound-coupling and supporting pedestals, each of which lies directly beneath a string and terminates in a distal end which is flared to form an enlarged base that is adapted to bear against the soundboard of the instrument.

17 Claims, 2 Drawing Sheets

BRIDGE FOR STRINGED MUSICAL INSTRUMENTS

BACKGROUND OF THE INVENTION

1. Field of the Invention

The present invention relates generally to bridge apparatus for stringed musical instruments, and more particularly to an improved bridge design which provides for a high degree of transmission of vibratory energy from each string directly to the sound board of the instrument.

2. Description of the Prior Art

The present invention is directed to bridges utilized in those types of instruments characterized by a resonant body or bell having a sounding board secured over the upper or outer side of the body with an elongated fingerboard-carrying neck having one end affixed to the body and an opposite end terminating in a head to which the string-tuning keys or pegs are mounted. In such instruments, spaced strings are secured to the head-mounted keys and are extended inwardly therefrom along and over the fingerboard and then across the sounding board and a bridge positioned on the board to means for attaching the strings to the board. The sounding board is typically a thin sheet of wood provided with an opening or sound hole underlying the strings to permit the sound waves to enter the interior of the body which, acting as a resonating chamber, enriches the tone of the strings, this tone being further enriched by the vibration of the sounding board itself acting as a kind of diaphragm. Sonic energy is transferred directly from the strings to the soundboard by the bridge which is mounted to the upper surface thereof between the sound hole and the end of the body remote from the neck of the instrument.

Although there are numerous types and configurations of bridges known in the prior art, the bridge type toward which the present invention is directed is that which is usually formed of a thin, hand-crafted wooden or plastic slab after having a set of transverse grooves along one of its edges in which the strings are tautly held. In the case of banjos, and what are commonly referred to as flattop guitars, the bridge is sometimes mounted unattachedly upon the resonant diaphragm or soundboard of the instrument and is held in place by the strings.

Heretofore, bridge designs have focused on attempts to limit soundwave energy absorption and dissipation within the bridge itself, and to enhance the tonal clarity of the sounds transmitted by the bridge. Design attempts at achieving this goal have been directed principally at shaping the periphery of the bridge in complex manners on a trial and error basis. Such bridges have been both costly and difficult to reproduce, particularly with consistency.

One example of such a bridge is disclosed in the U.S. Pat. No. of Geiger (No. 4,899,634) which is comprised of a thin wooden body having a base portion adapted to be supported upon the sounding board of an instrument, and a top crown portion that is formed with grooves for holding the individual strings. The base and crown portions have mating edges that are generally parallel with respect to each other. The crown is formed with baffled slits located adjacent the grooves and oriented obliquely with respect to the crown edge for redirecting soundwaves emitted from the strings back to the grooves to produce a ringing effect to the base to reduce sound attenuation within the bridge. In a secondary embodiment, a bridge is formed of a plurality of discrete bridge segments which individually support the several strings of the instrument and are coupled together by safety strings. Although the approach of the principal embodiment of this patent seeks to improve the coupling between the five strings and the soundboard, it uses only three pedestals to do so, with sound from all but the center string being directed laterally to a pedestal rather than directly downward to the sounding board. The alternative embodiment appears to provide a better solution in that it provides single structures for coupling sound from each string to the soundboard. However, such approach suffers from problems relating to stability, maintenance of position, and other unfavorable characteristics.

Ancient attempts at providing solutions somewhat related to Applicants' solution are disclosed in the 1921 German Patent to Lauten et al., the 1961 Design Patent to Ressler, and the 1899 Patent to Kohl (No. 30,515). However, although having apparent similarities to the subject invention, none address the same problem or provide the same solution to the problem provided by the present application; namely, separation and simultaneous maximization of energy transfer from each string to the soundboard with a minimum of coupling between adjacent string support pedestals.

SUMMARY OF THE INVENTION

It is therefore a primary objective of the present invention to provide a bridge device for stringed instruments that improves the sonic energy coupling between each string and the soundboard.

Another objective of the present invention is to provide a device of the type described wherein each string is supported substantially independently by a dedicated pedestal which couples the bulk of the sonic energy from a supported string to the soundboard.

Another object of the present invention is to provide a device of the type described which is economical to manufacture and has easily repeatable structural characteristics.

Briefly, a preferred embodiment of the present invention provides a stringed musical instrument bridge structure comprised of a single unitary member configured in a somewhat comblike structure, the backbone portion of which forms a string-engaging and supporting surface. The teeth-forming portions form a plurality of sound-coupling and supporting pedestals, each of which lies directly beneath a string and terminates in a distal end which is flared to form an enlarged base that is adapted to bear against the soundboard of the instrument.

An advantage of the present invention is that it can be easily manufactured and replicated at reasonable cost.

Another advantage of the present invention is that it provides a high degree of energy coupling between each string and the soundboard.

A further advantage of the present invention is that it substantially improves the sound of any instrument to which it is applied.

These and other objects and advantages of the present invention will no doubt become apparent to those skilled in the art after having read the following detailed description of the preferred embodiment which is illustrated in the several figures of the drawing.

IN THE DRAWING

DETAILED DESCRIPTION OF THE PREFERRED EMBODIMENT

Figure 1:
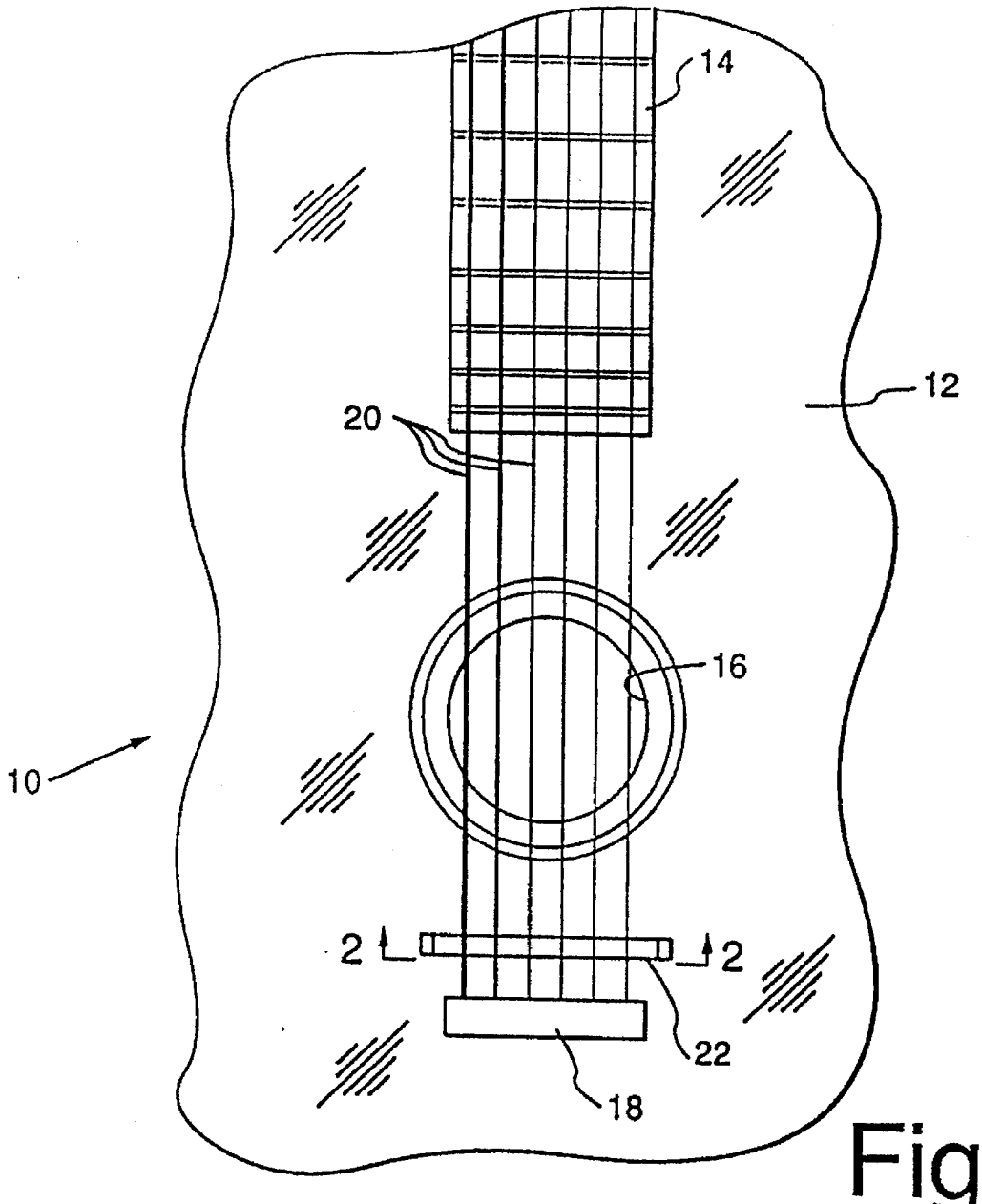
FIG. 1 is a partial plan view showing those portions of a six-string guitar proximate the position of a bridge in accordance with the present invention.

Referring now to FIG. 1 of the drawing, there is shown at 10 a partial plane view of the upper surface of a guitar soundboard 12 having one end of the fret-containing neck 14 affixed thereto, a sound opening 16 formed therein, a string-end-securing mechanism 18 affixed to the upper surface of soundboard 12 for securing one end of each of the strings 20, and a bridge 22 in accordance with the present invention disposed beneath the strings and between the mechanism 18 and sound opening 16.

Figure 2:
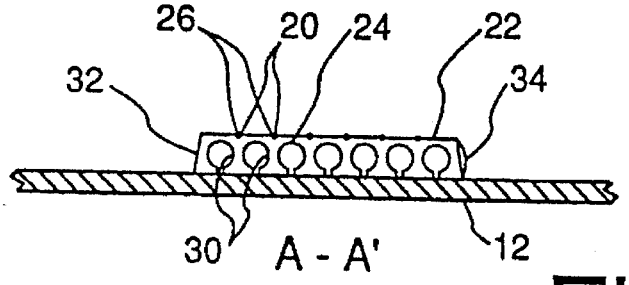
FIG. 2 is a transverse cross-section taken along the lines 2—2 of FIG. 1.

As depicted generally in the transverse cross-section of FIG. 2 taken along the line 2—2 of FIG. 1, the bridge 22 is comprised of a generally comb-shaped member having a backbone 24 extending across its upper edge, and having a plurality of transversely formed grooves 26 formed therein for receiving the strings 28. Disposed immediately beneath the grooves 26 and extending downwardly from the backbone 24 are teeth-like projections 30 which form pedestals for supporting each of the strings 28 and for coupling the sonic energy generated thereby into the soundboard 12. The ends of bridge 22 may be vertical, or sloped as indicated at 32, or rounded as indicated at 34.

Figure 3:
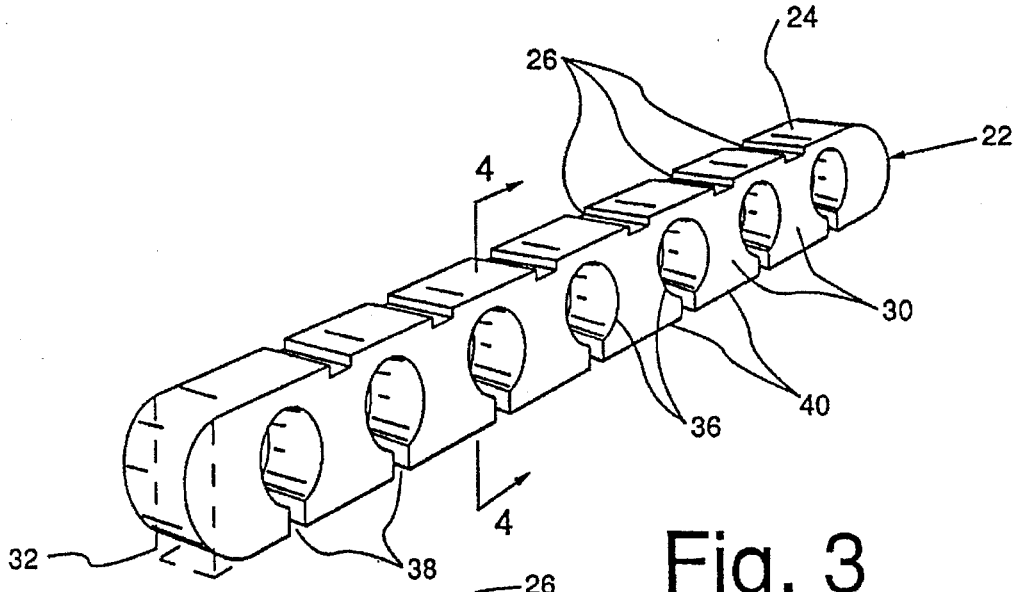
FIG. 3 is an enlarged perspective view illustrating in detail a preferred embodiment of the present invention.
Figure 4:
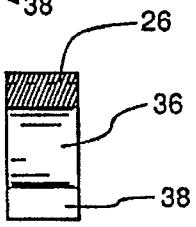
FIG. 4 is a transverse cross-section taken along the line 4—4 of FIG. 3.
Figure 5:
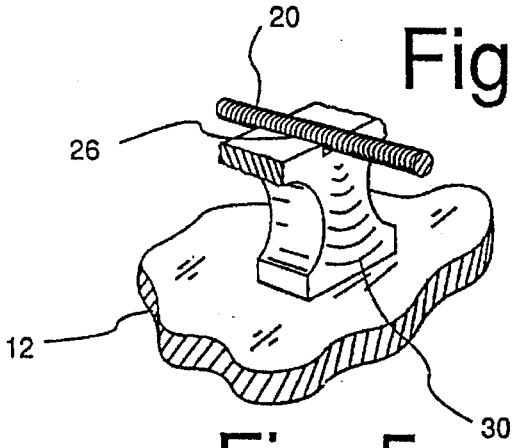
FIG. 5 is a partial perspective illustrating how one pedestal portion of the preferred embodiment supports one string.

Turning now to FIGS. 3–5, a preferred embodiment of the present invention will be described in detail. As depicted in FIG. 3, the bridge 22 is comprised of an elongated strip of hardwood, plastic or metal, which is machined, molded or extruded to provide the comblike configuration illustrated. In the preferred embodiment, the bridge has a width of approximately ¼" and a length suited to the particular type. Its height is tailored such that the upper edge or backbone 24 thereof is adapted to rise above the height of the last fret of the fingerboard by approximately 4.5–5.0 mm when the base of the bridge rests upon the soundboard. Note that the upper edge of backbone 24 is provided with six string-receiving, transversely oriented grooves 26 which respectively lie directly above and in line with six string-supporting pedestals 30 respectively formed and separated by generally key-shaped openings formed by cylindrical or elliptical apertures 36 and corresponding slots 38. A vertical cross-section taken through one of the slots and cylindrical openings is depicted in FIG. 4.

A better understanding of the functional aspects of each of the pedestals 30 may be obtained by reference to FIG. 5 wherein one of the pedestals 30 is broken from the bridge structure and shown supporting a string 20 above the soundboard 12. As will be noted, the lower end of pedestal 30 is rectangular in configuration and has a footprint substantially larger than the string-force-receiving upper surface portion formed by the bottom of groove 26. As a consequence, most of the energy coupled from string 20 to the bridge 22 is communicated directly through the pedestal to the portion of soundboard 12 lying directly beneath the pedestal footprint. It is believed that the pedestal-like structure of the present invention creates six discrete centers of sound in the soundboard from which the respective string sounds generated by the soundboard emanate. This separation of sounds is believed to be one of the reasons for the superior performance of the subject invention, Note that because of the particular positioning and configuration of the slots 38 and apertures 36 in the bridge, the backbone portion 24 thereof is relatively thin and flexible, and allows the bridge to conform to any irregularity or roundness of the soundboard, thereby further enhancing the sound-coupling feature of each pedestal.

As suggested earlier, the bridge of the present invention may be made of any hard material having good sound transmission properties. In the preferred embodiment, the device is made of a cast acrylic because such material is substantially unaffected by changes in humidity and is relatively easy to process. In order to manufacture such bridges in volume with highly repeatable characteristics, it may be desirable to saw each bridge from an elongated extrusion and then finish the piece with appropriate polishing and deburring. It may also be desirable to slightly round the surfaces forming the extremities of each groove 26 so as not to have sharp edges that in engaging a string would tend to fatigue and contribute to the failure of the string.

Another feature which has been found to improve operation of the bridge is to render the footing surface 40 of each pedestal irregular by abrading, sanding, grooving or the like, so as to increase the frictional engagement between the footing surface and the top of the soundboard.

It is important to note that because each pedestal has a relatively large footprint area, the tendency of the bridge to invade the plane of the soundboard top surface due to string pressure is reduced.

Figure 6:
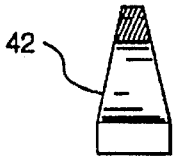
FIGS. 6 and 7 are cross-sections depicting alternate bridge forms.
Figure 7:
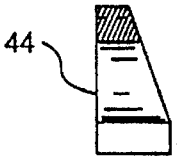

Although the preferred embodiment has a rectangular transverse cross-section, it will be appreciated that the invention can be implemented using other cross-sections, including the two illustrated at 42 and 44 in FIGS. 6 and 7, respectively, of the drawing. The only difference in such embodiment is that the backbone portion of the bridge is narrowed and one or both sides are tapered as illustrated.

Figure 8:
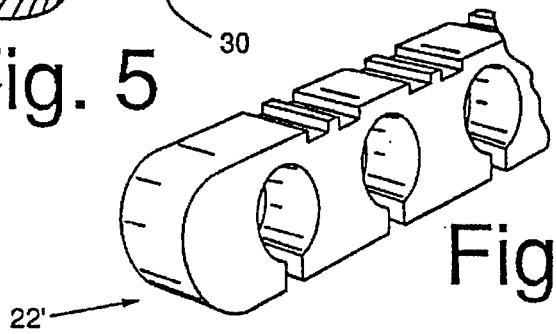
FIG. 8 depicts an alternative embodiment for use on a 12-string guitar.

In FIG. 8, an alternative embodiment is shown adapted for use with a 12-string guitar. Note that each set of strings is disposed immediately above one of the pedestals.

As described above, the generally comb-shaped bridge of the present invention provides the support function of a conventional bridge, but unlike the prior art establishes nearly independent support for each string, because it is somewhat flexible along its length. Each individual string rests primarily on a single pedestal which supports only that string and couples the vibration of the string into the soundboard. The wide foot provides stability at the base of each pedestal, while the flexible backbone formed in part by the narrow webs at the top of the bridge and spanning between each string position provides lateral support to each pedestal, preventing the pedestal from tipping. These webs are made to be thin enough to ensure that most of the vibratory energy of the strings is transmitted through the pedestals to the soundboard without the attenuation which would otherwise occur if all pedestals were rigidly fixed together.

Although the present invention has been described above in terms of a specific embodiment, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. A bridge for a stringed musical instrument, comprising:

an elongated comb-shaped member including an elongated backbone portion forming an upper surface of the bridge and having particular positions for engagement by each string of the instrument; and a plurality of tooth-like portions extending transverse to the length of said backbone portion, the distal ends of each tooth-like portion being flared to form an enlarged foot for engaging the soundboard of the instrument, said tooth-like portions forming pedestals for directly supporting at least one string and for transmitting vibratory energy from the supported string to said soundboard, said bridge being adapted for use with a six-string guitar and including six pedestals each adapted to support one of the six guitar strings.

2. A bridge for a stringed musical instrument as recited in claim 1, wherein said bridge is formed from a solid bar of material having a plurality of generally key-shaped openings formed therein, said pedestals being formed by the material remaining between adjacent ones of said key-shaped openings.

3. A bridge for a stringed musical instrument as recited in claim 2, wherein said backbone portion is provided with transverse slots for receiving the strings of the musical instrument.

4. A bridge for a stringed musical instrument as recited in claim 3, wherein each said pedestal has a relatively narrow waist portion and said distal end terminates in a rectangular surface substantially wider than said narrow waist portion.

5. A bridge for a stringed musical instrument as recited in claim 4, wherein said rectangular surface is irregular so as to provide good frictional contact with the upper surface of said soundboard.

6. A bridge for a stringed musical instrument as recited in claim 1, wherein said backbone portion is provided with transverse slots for receiving the strings of the musical instrument.

7. A bridge for a stringed musical instrument as recited in claim 1, wherein each said pedestal has a relatively narrow waist portion and said distal end terminates in a rectangular surface substantially wider than said narrow waist portion.

8. A bridge for a stringed musical instrument as recited in claim 4, wherein said rectangular surface is irregular so as to provide good frictional contact with the upper surface of said soundboard.

9. A bridge for a stringed musical instrument, comprising:

an elongated comb-shaped member including an elongated backbone portion forming an upper surface of the bridge and having particular positions for engagement by each string of the instrument; and a plurality of tooth-like portions extending transverse to the length of said backbone portion, the distal ends of each tooth-like portion being flared to form an enlarged foot for engaging the soundboard of the instrument, said tooth-like portions forming pedestals for directly supporting at least one string and for transmitting vibratory energy from the supported string to said soundboard, said bridge being adapted for use with a twelve-string guitar and including six pedestals each adapted to support two of the twelve guitar strings.

10. A bridge for a stringed musical instrument as recited in claim 9, wherein said bridge is formed from a solid bar of material having a plurality of generally key-shaped openings formed therein, said pedestals being formed by the material remaining between adjacent ones of said key-shaped openings.

11. A bridge for a stringed musical instrument as recited in claim 10, wherein said backbone portion is provided with transverse slots for receiving the strings of the musical instrument.

12. A bridge for a stringed musical instrument as recited in claim 11, wherein each said pedestal has a relatively narrow waist portion and said distal end terminates in a rectangular surface substantially wider than said narrow waist portion.

13. A bridge for a stringed musical instrument as recited in claim 12, wherein said rectangular surface is irregular so as to provide good frictional contact with the upper surface of said soundboard.

14. A bridge for a stringed musical instrument as recited in claim 9, wherein said backbone portion is provided with transverse slots for receiving the strings of the musical instrument.

15. A bridge for a stringed musical instrument as recited in claim 9, wherein each said pedestal has a relatively narrow waist portion and said distal end terminates in a rectangular surface substantially wider than said narrow waist portion.

16. A bridge for a stringed musical instrument as recited in claim 15, wherein said rectangular surface is irregular so as to provide good frictional contact with the upper surface of said soundboard.

17. A bridge for a stringed musical instrument, comprising:

an elongated comb-shaped member including an elongated backbone portion forming an upper surface of the bridge and having particular positions for engagement by each string of the instrument; and a plurality of tooth-like portions extending transverse to the length of said backbone portion, the distal ends of each tooth-like portion being flared to form an enlarged foot for engaging the soundboard of the instrument, said tooth-like portions forming pedestals for directly supporting at least one string and for transmitting vibratory energy from the supported string to said soundboard, said bridge being adapted to use with an n-string instrument and including n pedestals each adapted to support one of the n strings wherein n is an integer in the range of 4 through 6.

* * * * *